United States Patent [19]

Cornia et al.

[11] 3,983,816

[45] Oct. 5, 1976

[54] COMPOSITIONS FOR PRODUCING FLICKERING SIGNALS

[75] Inventors: Richard P. Cornia, Logan, Utah; Russell Reed, Jr., Ridgecrest, Calif.

[73] Assignee: Thiokol Corporation, Newton, Pa.

[22] Filed: Jan. 16, 1974

[21] Appl. No.: 433,645

[52] U.S. Cl. ..... 102/37.8; 149/19.3; 149/43; 149/87; 149/116

[51] Int. Cl.[2] ..... F42B 4/26; C06B 45/10; C06B 33/04; C06B 27/00

[58] Field of Search ..... 102/37.8, 35, 31; 149/43, 41, 87, 19.3, 116

[56] References Cited

UNITED STATES PATENTS

| | | | |
|---|---|---|---|
| 2,170,815 | 8/1939 | Eroe | 102/37.8 |
| 2,481,987 | 9/1949 | Dwyer | 102/37.8 |
| 2,968,542 | 1/1961 | Brock | 149/43 |
| 3,152,935 | 10/1964 | Cadwallader | 149/87 |
| 3,255,058 | 6/1966 | Wyman et al. | 149/87 |
| 3,441,455 | 4/1969 | Woods et al. | 149/87 |
| 3,488,237 | 1/1970 | Hiltz | 149/43 |
| 3,490,966 | 1/1970 | Hiltz | 149/41 |
| 3,680,483 | 8/1972 | Staudacher et al. | 102/37.8 |
| 3,690,972 | 9/1972 | Kaye | 149/19.3 |

*Primary Examiner*—Charles T. Jordan
*Attorney, Agent, or Firm*—Stanley A. Marcus; Edward E. McCullough

[57] ABSTRACT

The compositions burn to produce flickering signals of flame and smoke, and which in addition emit infrared and radar signals. The compositions comprise a fuel of either magnesium, aluminum or both, a reactive chlorinated aromatic compound such as hexachlorobenzene, one or more oxidizers selected from nitrates and perchlorates of ammonium, barium, cesium, lithium, potassium, sodium, and strontium, and a binder of a fluorinated polymer.

21 Claims, 2 Drawing Figures

COMPOSITIONS FOR PRODUCING FLICKERING SIGNALS

BACKGROUND OF THE INVENTION

1. Field of the Invention

The compositions are pyrotechnics which burn to simultaneously produce flickering signals of flame and smoke, and which emit infrared and radar signals.

2. Description of the Prior Art

The compositions presently used for signals produce either steady visible flames or steady visible smoke clouds; improvements in these are directed towards increasing the smoke density or the intensity of the light or its color purity as described in U.S. Pat. Nos. 2,968,542; 3,488,237; and 3,490,966. Although these prior art compositions are suitable for visible detection, they are not suitable for simultaneous detection by visible, infrared and radar means. New compositions are required to achieve these objectives. The compositions described herein achieve these objectives and further enhance detectability by producing flickering, that is regulated pulses of flame, smoke, infrared and radar signals.

SUMMARY OF THE INVENTION

The compositions comprise a fuel selected from aluminum, passivated magnesium and their mixtures, one or more reactive chlorinated aromatic compounds that have at least 80 percent of the reactive carbon atoms of the aromatic nucleus chlorinated, one or more oxidizers selected from nitrates and perchlorates of ammonium, barium, cesium, lithium, potassium, sodium, and strontium, and a binder of one or more curable, fluorinated polymers which form a binder with between 55 to 76 weight per cent of fluorine. The compositions burn to produce flickering signals, which are regulated pulses of detectable flames, smoke, infrared and radar signals. A composition of passivated magnesium, ammonium perchlorate, cesium nitrate, hexachlorobenzene, and a binder formed from a mixture of vinylidene fluoride and hexafluoropropylene (du Pont's Viton A) dissolved in 1, 1, 7-trihydrododecafluoroheptyl acrylate and modified and crosslinked with acrylate and methacrylate crosslinking compounds of glycidyl methacrylate,. triethyleneglycol diacrylate and propylene monoacrylate burns to simultaneously produce flame, smoke, infrared and radar signals which flicker at a rate between 1.5 and 3.0 cycles per second. This pulsing rate depends on the over pressure as well as the ingredients of the composition. When using the compositions as flares, the compositions can be burnt in a conventional flare case, or in a specially designed case which maintains a constant difference between burning pressure and ambient pressure. This difference is the overpressure. Maintaining a constant overpressure insures that the signal flickers at a constant rate for that particular composition. The specially designed flare case comprises an insulated case of cylindrical shape with a nozzle at one end sized to produce an overpressure within the range from 2.0 to 5.4 psia.

DESCRIPTION OF THE PREFERRED EMBODIMENTS

Figure 1:
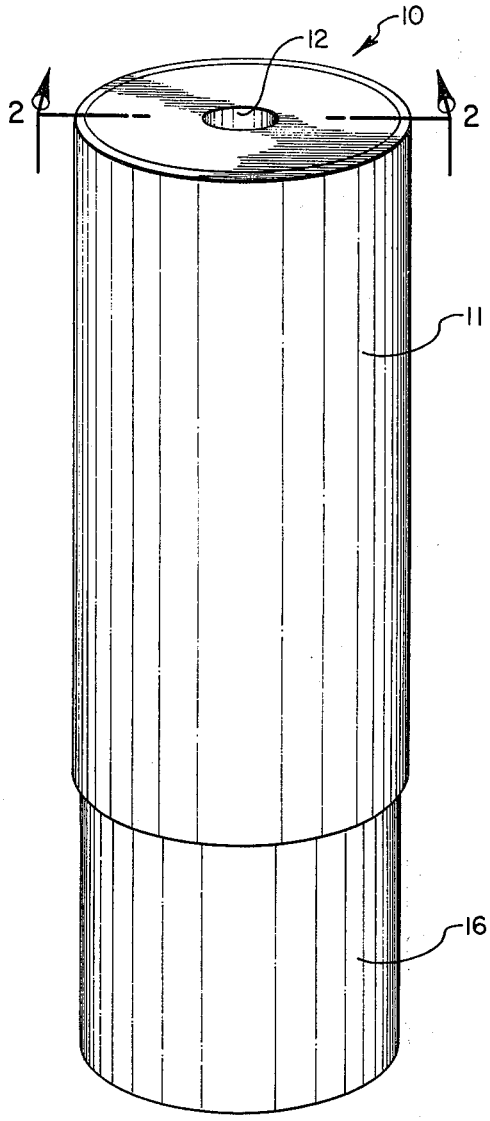
FIG. 1 is a perspective view of the flare case.
Figure 2:
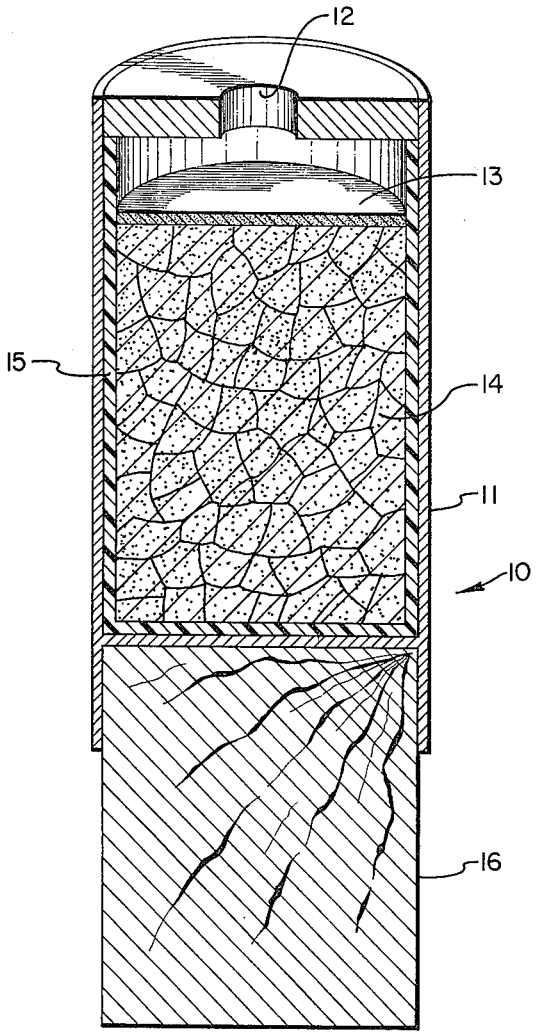
FIG. 2 is a longitudinal cross sectional view of a flare case loaded with the signal composition.

These compositions comprise a fuel, one or more oxidizers, one or more chlorinated aromatics, and a binder of one or more fluorinated polymers; each of the ingredients synergistically interacting to form flame, smoke, infrared, and radar signals which flicker on and off during burning of the composition. These signal pulses are regulated in that there is a pulse consisting of flame, smoke, infrared and radar signals followed by a period of no signal activity, and then by another pulse. The pulses occur at a constant rate depending upon the composition and the burning pressure.

The compositions use a fuel of magnesium, aluminum, or mixtures of aluminum and magnesium, with particle sizes between 5 to 15 microns. It was discovered that magnesium required passivation by hydrogen fluoride to form a magnesium fluoride coating on the surface of the particle. One method of achieving this is to react the magnesium with a hydrofluoric acid solution; other methods use hydrogen fluorine gas or fluorine. About 20 to 30 weight per cent of magnesium provides stable compositions, but about 16 to 40 weight per cent of aluminum may be used. The optimum weight, however, depends upon the burning rate and pulse rate desired as well as the amount of the other ingredients. Table I illustrates a composition using magnesium, but aluminum or a mixture of aluminum and magnesium may be substituted for the magnesium.

The oxidizer or oxidizers which the compositions use are oxygenated salts, such as ammonium nitrate, barium nitrate, cesium nitrate, lithium nitrate, potassium nitrate, sodium nitrate, strontium nitrate, ammonium perchlorate, barium perchlorate, cesium perchlorate, lithium perchlorate, potassium perchlorate, sodium perchlorate, strontium perchlorate, and their equivalents. The oxidizers react with the fuel to produce the combustion energy needed for dispersing the smoke, for emission of flame and infrared radiations, and in some cases electrons for radar detection. The oxidizing characteristics of the oxidizers, in most cases, stem from the anion of the salts, such as the nitrate or perchlorate ions. The cations of the salts particularly sodium, strontium, lithium, barium, and potassium ions are thought to contribute color emitting species to the flames. For example, strontium combines with chlorine to form strontium chloride species which emit red colored flames. The exact mechanism and the flame emitting species occurring during combustion are not known, but compositions with sodium salts provide strong yellow flames; those with lithium, potassium, and/or strontium salts produce a reddish flame, and those with barium salts produce a green flame. The other salts, particularly cesium salts in small amounts produce radar signals which are readily detected when a flare is ejected from a flying craft. Potassium salts and sodium salts, if used in greater amounts, produce detectable radar signals under these conditions. The choice of the oxidizer or oxidizers depends upon the type of flame color and burn rate desired, and the total weight per cent of the oxidizers can vary from 15 to 20 weight per cent. The compositions of Table I illustrates the use of hexachlorobenzene, but tetra or pentachlorinated benzene could be used. It is thought that these compounds contribute carbon species which produce dense blackish smoke and emit infrared radiation, and that the chlorine atoms assist in producing colored flames.

All compositions use a binder with a fluorine content from 55 to 76 weight per cent of the binder, and the binder is formed from one or more fluorinated, curable polymers. The type of fluorinated polymer depends upon the composition manufacturing procedure. For example, extruded compositions can use fluorinated vinyls. The term fluorinated vinyl designated a compound of the type: $C_1XY:C_2ZR$ wherein there is a polymerizable double bond between carbon atoms 1 and 2; R is hydrogen, fluorine, chlorine, methyl, or fluorinated alkyls and aromatics; X, Y, and Z are fluorine, hydrogen, chlorine, alkyl, aromatic, or other fluorinated alkyl or aromatics which do not interfere with polymerization. Examples of such compounds are trifluorochloroethylene, trifluoroethylene, tetrafluoroethylene and their co-polymers. Polymers for castable compositions are fluorinated acrylates, polyesters, polyurethanes, such as copolymers formed from a mixture of vinylidene fluoride and hexafluoropropylene (Viton A manufactured by du Pont) dissolved in 1, 1, 7-trihydrododecafluoroheptyl acrylate modified and crosslinked by one or more acrylate or methacrylate cross linkers, such as glycidyl methacrylate, triethyleneglycol diacrylate and propyleneglycol monoacrylate. The binder of the castable composition shown in Table I is formed from a mixture of vinylidene fluoride and hexafluoropropylene, designated as Viton A, dissolved in 1, 1, 7-trihydrododecafluoroheptyl acrylate, modified and crosslinked with several acrylate and methacrylate cross linkers.

The composition of Table I burns at a rate of 0.02 inches per second, and flickers or oscillates within the range of 1.5 to 3.0 cycles per second. This oscillation rate depends upon the over pressure, which is the difference between the ambient atmospheric pressure and the burning pressure within the flare case. The composition of Table I illustrates one embodiment of this invention, and other ingredients, described previously, may be substituted to achieve different burn rates, different pulse rates, and different flame and smoke colors.

Although the composition shown in Table I may be used alone, it was discovered that better control is achieved when the composition burns within a flare case designed to maintain a constant over pressure. The drawing illustrates one such flare case. The flare 10 of the drawing has a case 11 equipped with a nozzle 12 and an igniting means, such as a layer of rapidly ignitable material 13 which ignites by pulling a wire (not shown). When ignited, the compositon 14 burns and an over pressure develops because of throttling by nozzle 12. This over pressure depends upon the burning rate and the nozzle opening, and should be sized for a range between 2.0 to 5.4 psia. For example, when the composition shown in Table I is cast into a grain 1.38 inches in diameter and 2.5 inches long and burnt in a flare case with a 0.25 inch nozzle opening, an over pressure of 4.4 psia develops. This over pressure regulates the pulse rate. The curve of the pulsing rate versus pressure is parabolic with the pulsing rate increasing at lower over pressures, decreasing to a minimum as the over pressure increases and then increasing with an increase in pressure to the point of continuous burning. The case 11 is insulated, and in this embodiment a phenolic insert 15 insulates the case. There is a means for positioning the nozzle in the direction of the intended observer, such as handle 16 attached to the case at the end opposite the nozzle. However, it can be attached at other positions. Furthermore, the composition and flare case can be mounted on a floatation device to form a signal for ocean and sea use.

The invention as described is not to be limited only by the examples and embodiments shown, but also by the appended claims.

TABLE I

| Compositions | Wt % |
|---|---|
| Magnesium (−200+325 mesh) | 24.0 |
| Ammonium Perchlorate (200 micron) | 10.0 |
| Ammonium Perchlorate (3 micron) | 5.0 |
| Cesium Nitrate | 1.0 |
| Hexachlorobenzene | 20.0 |
| Binder | |
| Viton A dissolved in 1, 1, 7-trihydrododecafluoroheptyl acrylate | 39.1 |
| Glycidyl Methacrylate | 0.1 |
| Benzoyl peroxide | 0.5 |
| Triethyleneglycol diacrylate | 0.2 |
| Propyleneglycol monoacrylate | 0.1 |

We claim:

1. A composition producing signal pulses when burning which comprises:

a fuel selected from the group consisting of aluminum, passivated magnesium, and mixtures thereof, at least one reactive, chlorinated aromatic compound with at least 80 per cent of the reactive carbon atoms of the aromatic nucleus chlorinated.

at least one oxidizer selected from the group consisting of ammonium nitrate, barium nitrate, cesium nitrate, lithium nitrate, potassium nitrate, sodium nitrate, strontium nitrate, ammonium perchlorate, barium perchlorate, cesium perchlorate, lithium perchlorate, potassium perchlorate, sodium perchlorate, and strontium perchlorate, and a binder with a fluorine content within the range of 55 to 76 weight per cent of the binder formed from at least one fluorinated polymer.

2. A composition producing signal pulses when burning which comprises:

a fuel selected from the group consisting of aluminum, passivated magnesium, and mixtures thereof, at least one chlorinated aromatic compound selected from the group consisting of hexachlorobenzene, pentachlorobenzene, and tetrachlorobenzenes, at least one oxidizer selected from the group consisting of ammonium nitrate, barium nitrate, cesium nitrate, lithium nitrate, potassium nitrate, sodium nitrate, strontium nitrate, ammonium perchlorate, barium perchlorate, cesium perchlorate, lithium perchlorate, potassium perchlorate, sodium perchlorate, and strontium perchlorate, and a binder formed from at least one fluorinated polymer with a fluorine content within the range from 55 to 76 weight per cent of the binder.

3. A composition producing signal pulses when burning, which comprises:

a fuel selected from the group consisting of aluminum, passivated magnesium, and mixtures thereof, at least one chlorinated aromatic compound selected from the group consisting of hexachlorobenzene, pentachlorobenzene, and tetrachlorobenzenes, at least one oxidizer selected from the group consisting of ammonium nitrate, barium nitrate, cesium nitrate, lithium nitrate, potassium nitrate, sodium nitrate, strontium nitrate, cesium perchlorate, ammonium perchlorate, lithium perchlorate, potassium perchlorate, sodium perchlorate, and strontium perchlorate, and a binder formed from at least one fluorinated polymer with a fluorine content within the range from 55 to 76 weight per cent of the polymer; said polymer selected from the group consisting of fluorinated acrylates, fluorinated methacrylates and fluorinated vinyls.

4. A composition producing signal pulses when burning, which comprises:

a fuel selected from the group consisting of aluminum, passivated magnesium, and mixtures thereof, hexachlorobenzene, at least one oxidizer selected from the group consisting of ammonium nitrate, barium nitrate, cesium nitrate, lithium nitrate, potassium nitrate, sodium nitrate, strontium nitrate, ammonium perchlorate, cesium perchlorate, barium perchlorate, lithium perchlorate, potassium perchlorate, sodium perchlorate, and strontium perchlorate, and a binder formed from at least one fluorinated polymer with a fluorine content within the range from 55 to 76 weight per cent of the polymer; the polymer selected from the group consisting of trifluorochloroethylene, tetrafluoroethylene, copolymers of trifluorochloroethylene and tetrafluoroethylene, copolymers formed from a mixture of vinylidene fluoride and hexafluoropropylene dissolved in 1, 1, 7-trihydrododecafluoroheptyl acrylate, and copolymers formed from a mixture of vinylidene fluoride and hexafluoropropylene dissolved in 1, 1, 7-trihydrododecafluoroheptyl acrylate and at least one crosslinker selected from the group consisting of acrylate and methacrylate crosslinkers.

5. A composition for signaling and other analogous uses, producing signal pulses when burning, which comprises:

passivated magnesium, hexachlorobenzene, a plurality of oxidizers selected from the group consisting of ammonium nitrate, barium nitrate, cesium nitrate, lithium nitrate, potassium nitrate, sodium nitrate, strontium nitrate, ammonium perchlorate, barium perchlorate, cesium perchlorate, lithium perchlorate, potassium perchlorate, sodium perchlorate, and strontium perchlorate, and a binder of a polymer formed from a mixture of vinylidene fluoride and hexafluoropropylene dissolved in 1,1,7-trihydrododecafluoroheptyl acrylate, and at least one crosslinker selected from the group consisting of acrylate and methacrylate crosslinkers.

6. A composition producing signal pulses when burning, which comprises:

a fuel selected from the group consisting of aluminum, passivated magnesium, and mixtures thereof, hexachlorobenzene, a first oxidizer selected from the group consisting of ammonium nitrate, barium nitrate, lithium nitrate, strontium nitrate, ammonium perchlorate, barium perchlorate, lithium perchlorate, and strontium perchlorate, a second oxidizer selected from the group consisting of cesium nitrate, potassium nitrate, sodium nitrate, cesium perchlorate, potassium perchlorate, and sodium perchlorate, and a binder formed from at least one fluorinated polymer selected from the group consisting of trifluoroethylene, tetrafluoroethylene, copolymers of trifluoroethylene and tetrafluoroethylene, copolymers formed from a mixture of vinylidene fluoride and hexafluoropropylene dissolved in 1, 1, 7-trihydrodecafluoroheptyl acrylate, and copolymers formed from a mixture of vinylidene fluoride and hexafluoropropylene dissolved in 1, 1, 7-trihydrododecafluoroheptyl acrylate, and at least one crosslinker selected from the group of acrylate and methacrylate crosslinkers.

7. A composition producing signal pulses when burning, which comprises:

from 20 to 30 weight per cent of passivated magnesium, from 20 to 28 weight per cent of hexachlorobenzene, from 15 to 20 weight per cent of ammonium perchlorate, and a binder formed from at least one fluorinated polymer with a fluorine content within the range from 55 to 76 weight per cent of the polymer.

8. The composition as recited in claim 7 which further comprises 1 to 2 weight per cent of cesium nitrate.

9. A composition producing signal pulses when burning, which comprises:

from 20 to 30 weight per cent of passivated magnesium, from 20 to 28 weight per cent of hexachlorobenzene, from 15 to 20 weight per cent of ammonium perchlorate, and a binder formed from a mixture of vinylidene fluoride and hexafluoropropylene dissolved in 1, 1, 7-trihydrododecafluoroheptyl acrylate, and at least one crosslinker selected from the group consisting of acrylate and methacrylate crosslinkers.

10. The composition as recited in claim 9 which further comprises from 1 to 2 weight per cent of cesium nitrate.

11. A composition producing signal pulses when burning, which comprises:

from 20 to 30 weight per cent of aluminum, from 20 to 28 weight per cent of hexachlorobenzene, from 15 to 20 weight per cent of ammonium perchlorate, and a binder of at least one fluorinated polymer with a fluorine content within the range from 55 to 76 weight per cent of the polymer.

12. The composition as recited in claim 11 which further comprises from 1 to 2 weight per cent of cesium nitrate.

13. A composition for signaling and other analogous uses, producing pulses of a flame and a smoke when burning, which comprises:

from 24 to 26 weight per cent of a fuel selected from aluminum, passivated magnesium, and mixtures thereof, from 20 to 22 weight per cent of hexachlorobenzene, from 15 to 20 weight per cent of ammonium perchlorate, and a binder of a polymer formed from a mixture of vinylidene fluoride and hexafluoropropylene dissolved in 1, 1, 7-trihydrododecafluoroheptyl acrylate and at least one crosslinker selected from the group consisting of acrylate and methacrylate crosslinkers.

14. The composition as recited in claim 13, which further comprises from 1 to 2 weight per cent of cesium nitrate.

15. The composition as recited in claim 13, which further comprises from 1 to 2 weight per cent of an oxidizer selected from the group consisting of cesium nitrate, cesium perchlorate, potassium nitrate, and potassium perchlorate.

16. A flare for producing signal pulses when burning, which comprises:

an insulated case with a nozzle, a composition within the flare case, producing pulses of flame and smoke when burning, which comprises:

a fuel selected from the group consisting of aluminum, passivated magnesium, and mixtures thereof, at least one reactive, chlorinated aromatic compound with at least 80 per cent of the reactive carbon atoms of the aromatic nucleus chlorinated, at least one oxidizer selected from the group consisting of ammonium nitrate, barium nitrate, cesium nitrate, lithium nitrate, potassium nitrate, sodium nitrate, strontium nitrate, ammonium perchlorate, barium perchlorate, cesium perchlorate, lithium perchlorate, potassium perchlorate, sodium perchlorate, and strontium perchlorate, a binder formed from at least one fluorinated polymer with a fluorine content within the range from 55 to 76 weight per cent of the polymer, and a means for igniting the composition; said nozzle sized to produce a burning over pressure within the range from 2.0 to 5.4 psia, the over pressure assisting the composition to burn with regulated pulsing.

17. The flare as recited in claim 16, wherein the case has a handle for positioning the nozzle in the direction of the intended observer.

18. A flare for producing signal pulses when burning, which comprises:

an insulated case with a nozzle, a composition within the case for producing signal pulses when burning, which composition comprises:

hexachlorobenzene, at least one oxidizer selected from the group consisting of ammonium nitrate, cesium nitrate, barium nitrate, lithium nitrate, potassium nitrate, sodium nitrate, strontium nitrate, ammonium perchlorate, barium perchlorate, strontium perchlorate, cesium perchlorate, lithium perchlorate, potassium perchlorate, and sodium perchlorate, and a binder formed from at least one fluorinated polymer with a fluorine content within the range from 55 to 76 weight per cent of the polymer; the polymer selected from the group consisting of trifluorochloroethylene and tetrafluoroethylene, copolymers formed from a mixture of vinylidene fluoride and hexafluoropropylene dissolved in 1, 1, 7-trihydrododecafluoroheptyl acrylate, and copolymers formed from a mixture of vinylidene fluoride and hexafluoropropylene dissolved in 1, 1, 7-trihydrododecafluoroheptyl acrylate and at least one crosslinker selected from the group consisting of acrylate and methacrylate crosslinkers, a fuel selected from the group consisting of aluminum, passivated magnesium, and mixtures thereof, and a means for igniting the composition; said nozzle sized to produce a burning over pressure within the range from 2.0 to 5.4 psia, to aid the composition to burn with regulated pulsing.

19. The flare as recited in claim 18, wherein the case has a handle for positioning the nozzle in the direction of the intended observer.

20. A flare for producing signal pulses when burning, which comprises:

a case with a nozzle, a composition within the case for producing signal pulses when burning, which comprises:

from 24 to 26 weight per cent of a fuel selected from aluminum, passivated magnesium, and mixtures thereof, from 20 to 22 weight per cent of hexachlorobenzene, from 15 to 20 weight per cent of ammonium perchlorate, and a binder formed from a polymer formed from a mixture of vinylidene fluoride and hexafluoropropylene dissolved in 1, 1, 7-trihydrododecafluoroheptyl acrylate and at least one crosslinker selected from the group consisting of acrylate and methacrylate crosslinkers, and a means for igniting the composition; said nozzle sized to produce a burning over pressure within the range from 2.0 to 5.4 psia, to assist the composition to burn with a regulated pulsing.

21. A flare as recited in claim 20, wherein the case has a handle for positioning the nozzle in the direction of the intended observer.

* * * * *